US011230861B2

(12) United States Patent
Trentham et al.

(10) Patent No.: US 11,230,861 B2
(45) Date of Patent: Jan. 25, 2022

(54) TRAILER ROLL DOOR AND LOCKING SYSTEM

(71) Applicant: Jerry D. Trentham Trucking, Inc., Glen Allen, MO (US)

(72) Inventors: Lucas W. Trentham, Glen Allen, MO (US); Jerry D. Trentham, Glen Allen, MO (US)

(73) Assignee: Jerry D. Trentham Trucking, Inc., Glen Allen, MO (US)

( * ) Notice: Subject to any disclaimer, the term of this patent is extended or adjusted under 35 U.S.C. 154(b) by 449 days.

(21) Appl. No.: 16/247,025

(22) Filed: Jan. 14, 2019

(65) Prior Publication Data

US 2019/0226239 A1 Jul. 25, 2019

Related U.S. Application Data

(60) Provisional application No. 62/616,745, filed on Jan. 12, 2018.

(51) Int. Cl.

| | |
|---|---|
| ***E05B 65/00*** | (2006.01) |
| ***B65D 90/02*** | (2019.01) |
| ***E05B 47/00*** | (2006.01) |
| ***E05C 19/00*** | (2006.01) |
| ***E05B 51/02*** | (2006.01) |
| ***E05B 83/02*** | (2014.01) |

(Continued)

(52) U.S. Cl.

CPC ..... *E05B 65/0021* (2013.01); *B65D 90/021* (2013.01); *B65D 90/008* (2013.01); *B65D 2211/00* (2013.01); *E05B 81/58* (2013.01); *E05B 2047/0094* (2013.01)

(58) Field of Classification Search

CPC ..... E05B 65/0021; E05B 2047/0094; E05B 81/58; E05B 51/02; E05B 83/02; B65D 90/021; B65D 2211/00; B65D 90/008; E05C 19/001; B62D 33/0273; B62D 33/0276; E06B 9/581; E06B 2009/588

USPC ..... 70/95–100, DIG. 11; 292/DIG. 32, 292/DIG. 36, DIG. 46; 160/273.1; 296/186.2, 186.3

See application file for complete search history.

(56) References Cited

U.S. PATENT DOCUMENTS 268,125 A * 11/1882 Reynolds
297,667 A * 4/1884 Brown
(Continued)

*Primary Examiner* — Lloyd A Gall
(74) *Attorney, Agent, or Firm* — Stinson LLP

(57) ABSTRACT

A door and locking system for a rear opening of a long bed trailer, the rear opening having a top edge, a bottom edge and first and second side edges, the door and locking system has a canvas door configured for mounting adjacent to the rear opening of the long bed trailer. The canvas door can move between a closed position in which the canvas door moves to close the rear opening and an open position in which the canvas door moves to open the rear opening. A locking system secured to the edges of the rear opening can move between a locked position, in which the locking system is in locking engagement with the canvas door in the closed position to secure the canvas door against the edges of the rear opening to close the opening for retaining fluidizable product in the long bed trailer and an unlocked position, in which the locking system is free from locking engagement with the canvas door to allow the canvas door to move into the open position.

20 Claims, 15 Drawing Sheets

(51) Int. Cl.
*E05B 81/58* (2014.01)
*B65D 90/00* (2006.01)

(56) References Cited

U.S. PATENT DOCUMENTS 1,922,389 A * 8/1933 Nye ..... E06B 9/582 160/273.1
3,431,964 A * 3/1969 Rogers ..... B61D 19/006 160/23.1
4,700,985 A * 10/1987 Whitehead ..... B60J 5/062 296/100.15
5,607,200 A * 3/1997 Smidler ..... B60J 7/104 160/378
5,702,147 A * 12/1997 Essig ..... B60J 7/104 135/119
5,848,631 A * 12/1998 DeGiovanni ..... E06B 9/581 160/133
6,942,003 B2 * 9/2005 Thompson ..... E06B 9/13 160/268.1
9,333,991 B2 5/2016 Petelka
2001/0020792 A1 * 9/2001 Huotari ..... B60J 7/102 296/100.16
2002/0096268 A1 * 7/2002 Schmeichel ..... B60P 7/04 160/328
2006/0124252 A1 * 6/2006 Miller ..... E05D 15/24 160/113
2007/0277938 A1 * 12/2007 Crider ..... E06B 7/232 160/121.1
2017/0204642 A1 * 7/2017 Tuzzio ..... E05B 47/0001
2019/0061497 A1 * 2/2019 Trinier ..... B60J 7/198
2020/0094660 A1 * 3/2020 Ma ..... B60J 7/185

* cited by examiner

TRAILER ROLL DOOR AND LOCKING SYSTEM

CROSS-REFERENCE TO RELATED APPLICATION

This application is the nonprovisional of U.S. Provisional Application Ser. No. 62/616,745, filed Jan. 12, 2018 and entitled TRAILER ROLL DOOR AND LOCKING SYSTEM, the disclosure of which is incorporated by reference as if set forth fully herein.

FIELD OF THE INVENTION

The present invention generally relates to doors used in long bed trailers. More particularly the invention relates to the rear door of a long bed trailer having a live floor.

BACKGROUND

Rectangular long bed trailers are commonly used to transport all kinds of materials in the transportation industry. The unique challenges associated with transporting and unloading particulate materials such as sawdust, wood chips, grains, corn, mulch and other such particulate materials having a fluidizable or liquid characteristic has resulting in the development and use of unique long bed trailers better suited to the transport of such particulate materials. Often called live floor trailers, these trailers have a retractable top to allow a front loader to dump the particulate material into the trailer and live floors to unload the particulate material through a rear opening. Typically, the rear opening is closed with hinged metal doors secured to the sides of the trailer.

As the particulate material is loaded into the live floor trailer, the material spreads out over the length of the bed and is supported by the rear doors. Because the particulate material is supported by the rear doors, when the rear doors are opened to unload the material, a portion of the particulate material typically falls out of the trailer. This can be very problematic for truck drivers. Often the particulate material is unloaded into barns or other structures with very tight spaces that barely fit the size of the trailer. Such tight spaces often prevent the rear doors from swinging into a fully opened position to allow the particulate material to be unloaded. Thus, the truck drivers are left with a choice when unloading the particulate material. The truck drivers can fully open the doors before backing into the delivery space where the material is to be unloaded. This can result in a portion of the particulate material falling from the trailer outside the delivery space. Such material must then be transported into the delivery space or go to waste. The second option is to back the trailer into the delivery space, open the rear doors as much as possible to allow the particular material that is supported by the rear doors, to fall into the delivery space. The truck driver will then have to pull forward and open the doors the rest of the way, which typically involves rotating and securing the doors to be alongside the exterior of the trailer sidewalls. Once the rear doors are secured in the open position, the truck driver can then back the trailer back into the delivery space and unload the particulate material using the live floor.

SUMMARY

A door and locking system for a rear opening of a long bed trailer, the rear opening having a top edge, a bottom edge and first and second side edges, the door and locking system generally comprising a canvas door configured for mounting adjacent to the rear opening of the long bed trailer. The canvas door is configured to move between a closed position in which the canvas door moves to close the rear opening and an open position in which the canvas door moves to open the rear opening. A locking system secured to the edges of the rear opening is configured to move between a locked position, in which the locking system is in locking engagement with the canvas door in the closed position to secure the canvas door against the edges of the rear opening to close the opening for retaining fluidizable product in the long bed trailer and an unlocked position, in which the locking system is free from locking engagement with the canvas door to allow the canvas door to move into the open position.

Other objects and features of the present invention will be in part apparent and in part pointed out hereinafter.

BRIEF DESCRIPTION OF THE DRAWINGS

Corresponding parts are indicated by corresponding reference characters throughout the several views of the drawings.

DETAILED DESCRIPTION

Figure 1:
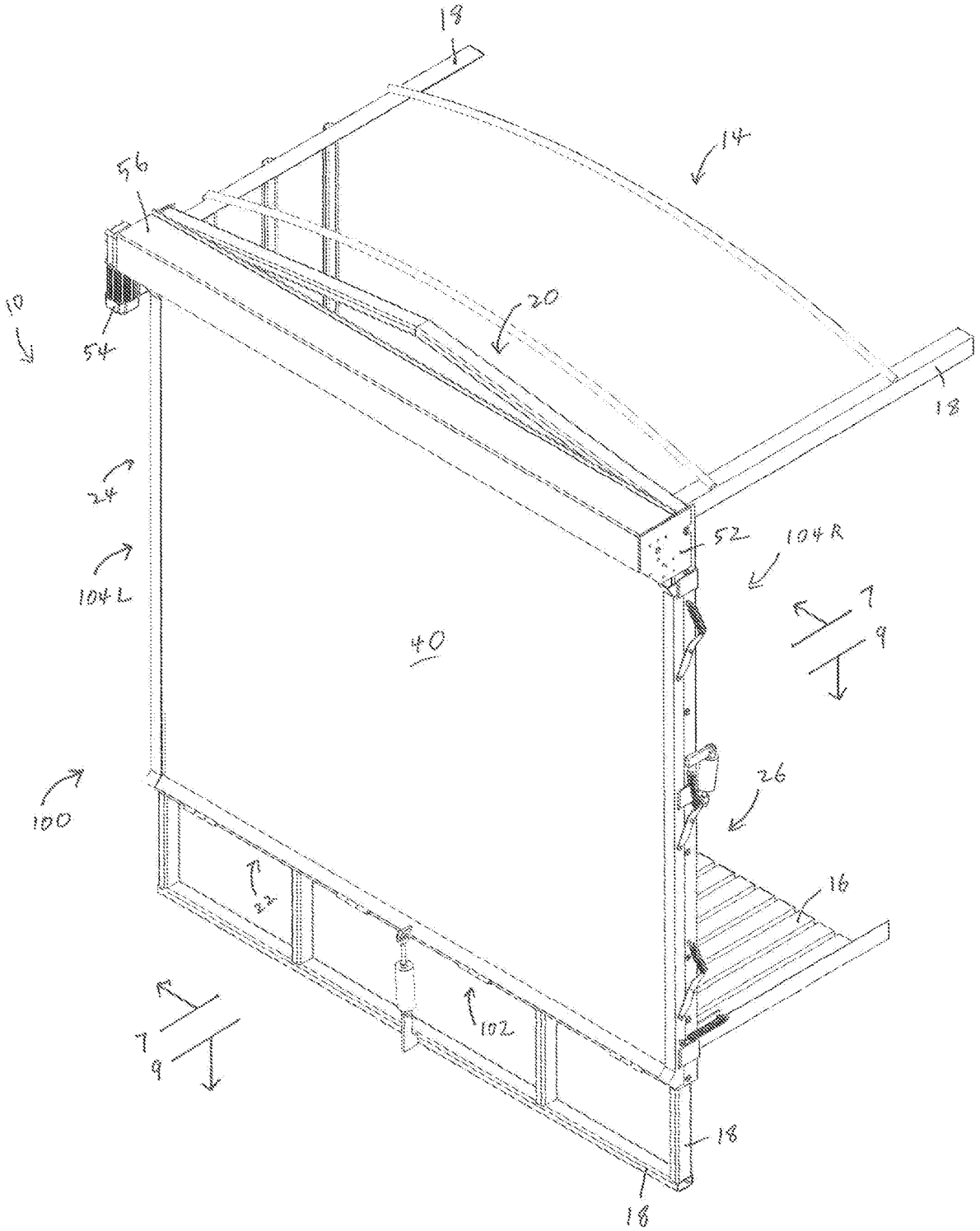
FIG. 1 is a front right perspective view of a door and locking system according to the present disclosure in a closed and locked position.
Figure 2:
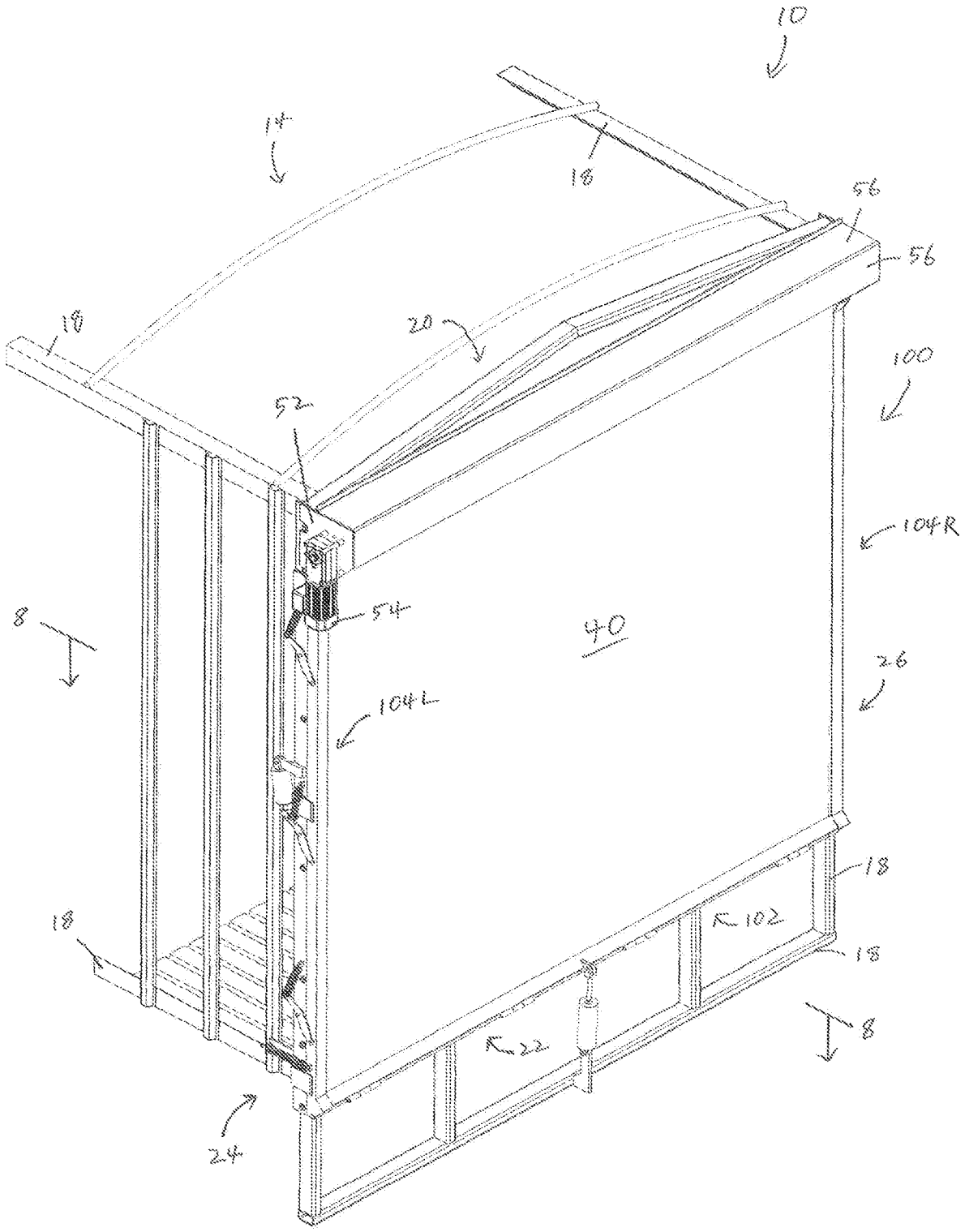
FIG. 2 is a front left perspective view thereof.

Referring to FIG. 1, a door and locking system of the present invention is generally shown at 10. The door and locking system 10 is shown attached to the rear opening 12 of a long bed trailer 14. In the illustrated embodiment, the long bed trailer 14 is a live floor trailer, although it will be understood that other types of trailers and/or containers could be used without departing from the scope of the present invention. The trailer 14 is illustrated only in a fragmentary (only a rear portion being shown), skeletonized fashion with certain portions removed in the drawings, as is required to explain the construction and operation of the door and locking system of the present invention. The person of ordinary skill in the art will readily understand the parts omitted. The trailer 14 has a live floor 16 and an exterior frame 18 defining the rear opening 12. The rear opening 12 is rectangular with a top edge 20, a bottom edge 22 and first and second side edges 24, 26. It is to be understood that the trailer 14 shown in the figures is illustrative and the trailer 14 may have other constructions than described herein that are within the scope of the present invention.

Figure 6:
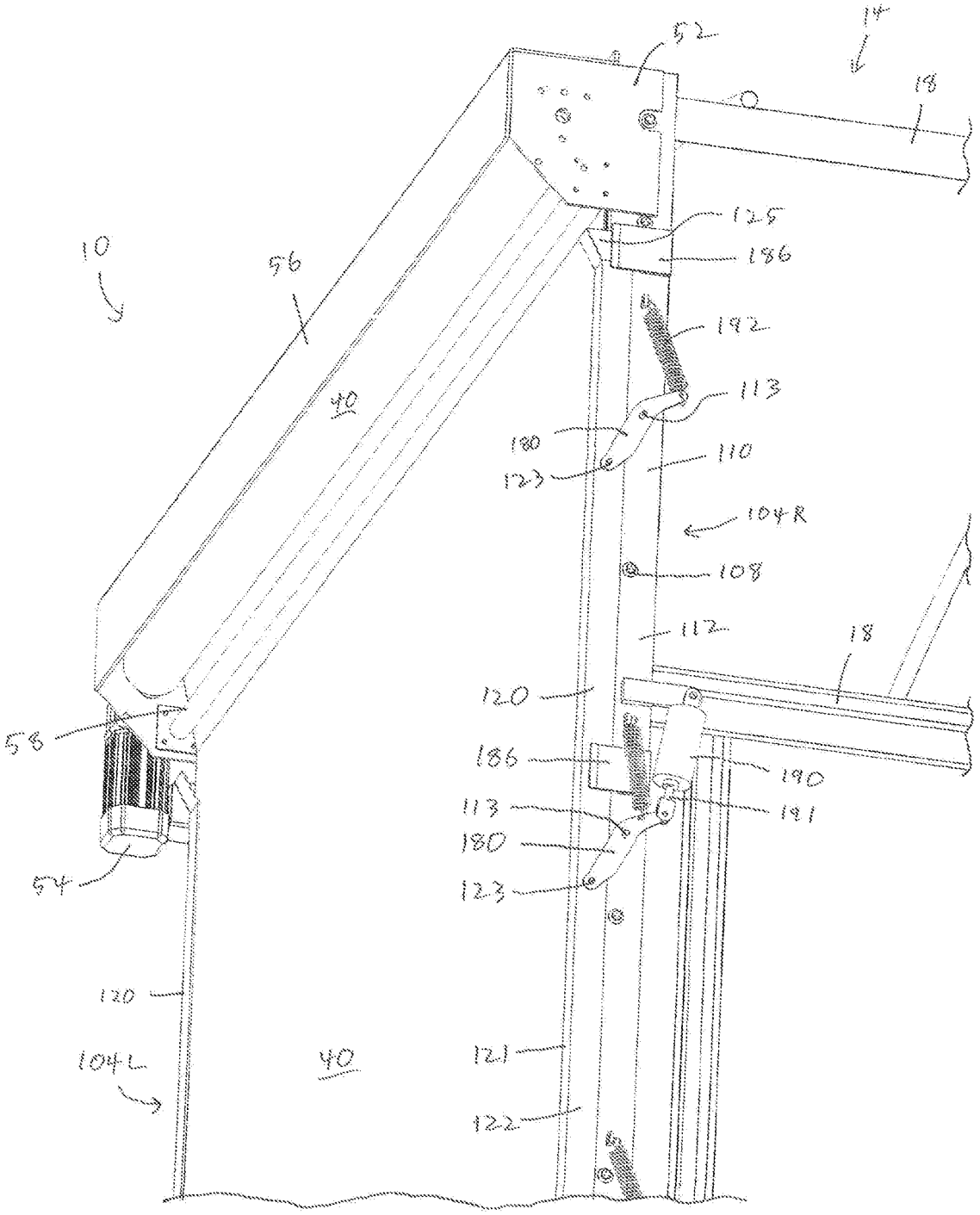
FIG. 6 is an enlarged fragmentary perspective view of the top thereof.
Figure 7:
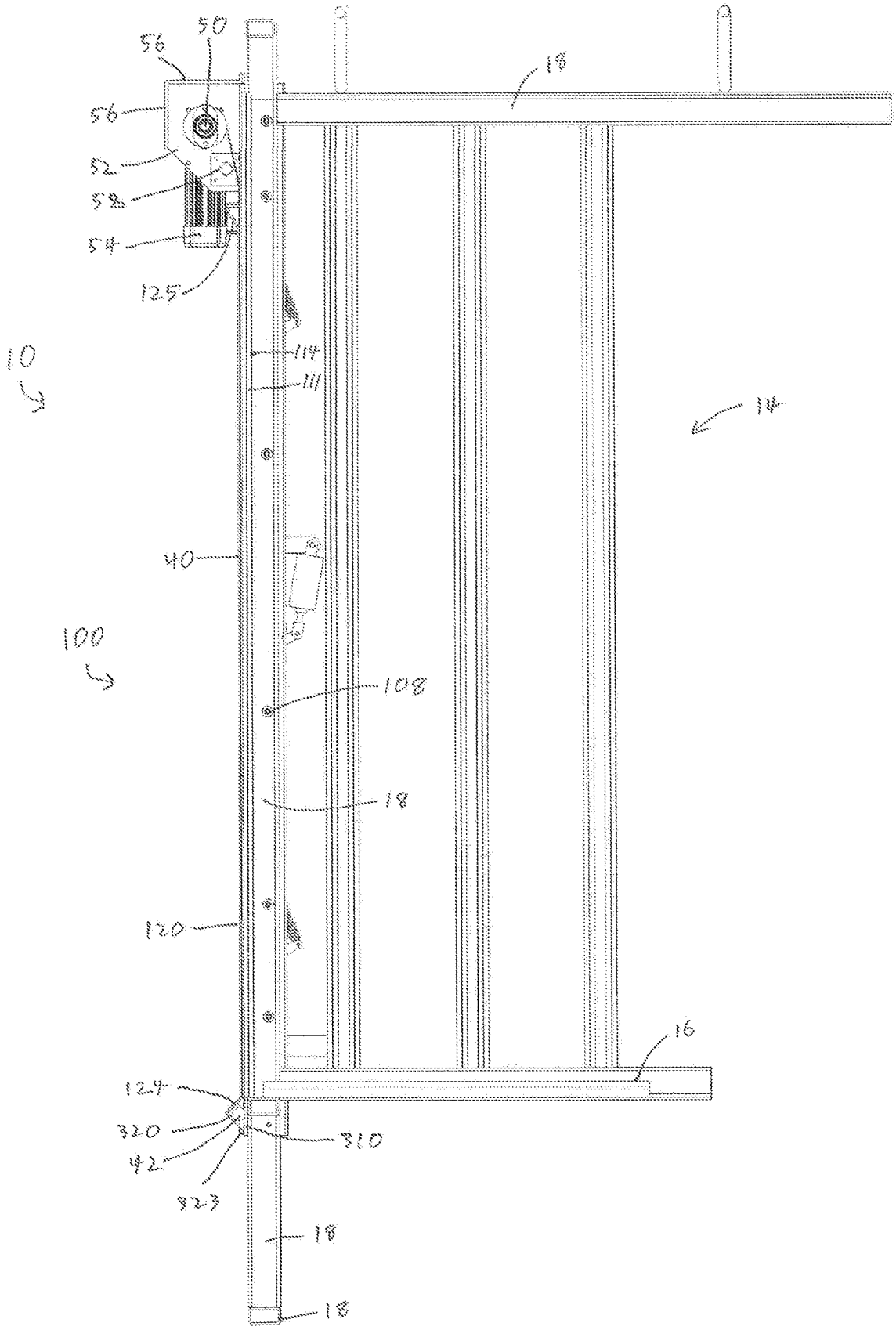
FIG. 7 is a vertical section taken through the line 7-7 of FIG. 1.
Figure 10:
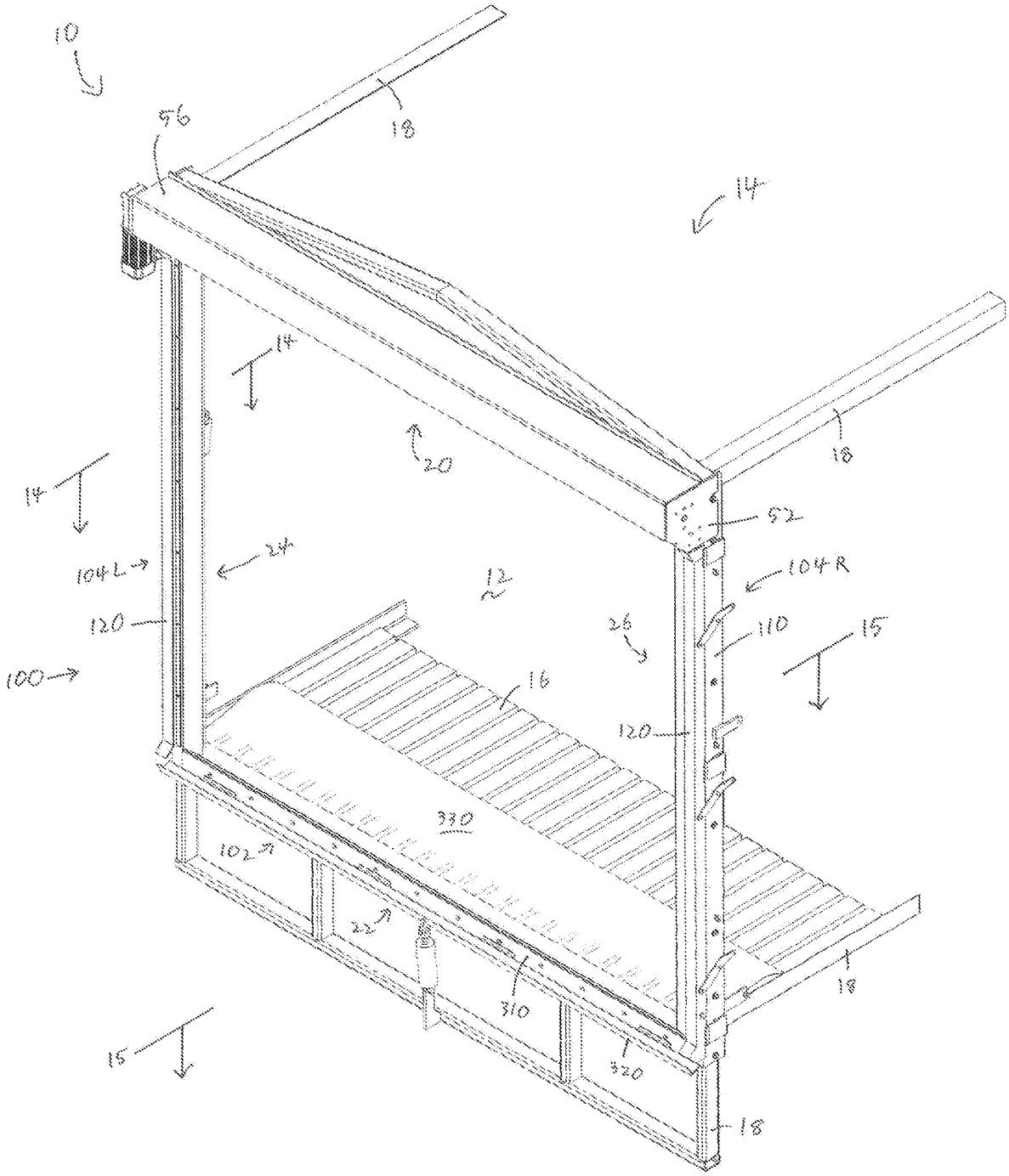
FIG. 10 is a front perspective view of the door and locking system in an open and unlocked position.

The door and locking system 10 is connected to the exterior of the trailer 14 and includes a canvas or tarp door 40 connected to a shaft 50 (FIG. 7) located adjacent to the top edge 20 of the rear opening 12. The canvas door 40 is wider than the rear opening 12 and has first and second side edge margins that overlap the first and second side edges 24, 26. The shaft 50 spans the width of the rear opening 12 and is supported on each end by a shaft mounting bracket 52. A motor 54 is secured to one mounting bracket 52 and is connected to the shaft 50. The canvas door 40 is wrapped around the shaft 50. The motor 54 rotates the shaft 50 to lower the canvas door 40 into a closed position, as seen in FIG. 1, or raise the canvas door into an open position, as seen in FIG. 10. The motor is powered by the truck's electrical system. As best seen in FIG. 7, a rod 42 is secured to the lower edge margin of the canvas door 40. In the closed position, the canvas door 40 overlaps the bottom edge 22 of the rear opening 12. The rod 42 helps to hold the canvas door in a flat configuration and provides additional mass which helps the canvas door move into the closed position. In addition, as described in more detail below, the rod 42 engages the locking system 100 to secure the canvas door 40 in a closed position. Protective coverings 56 are placed around the shaft 50 and are fixed to the shaft mounting brackets 52 to protect the shaft and the top of the canvas door 40 from the elements. A guide bar 58 (FIG. 6) is positioned below the shaft 50 and positions the canvas door 40 adjacent to the rear opening 12. To position the canvas door 40 and shaft 50 near the top edge 20 of the rear opening 12, each shaft mounting bracket 52 is fixed to the top of a side mounting flange 110 of the locking assembly 100.

The locking mechanism 100 is attached to the trailer 14 along the first and second side edges 24, 26 and the bottom edge 22 (i.e. first, second and third edges of the rear opening). Along each of the first edge, the second edge and the third edge, the locking mechanism 100 includes a locking subassembly 104L, 104R, 102 having a clamp and a mounting flange. Each mounting flange is attached to the exterior of the trailer 14 around the rear opening 12. Each clamp is attached to a respective mounting flange. The canvas door 40 is positioned such that the door's first, second and lower edge margins passes in-between a clamp and a mounting flange as the door is raised and lowered. In the locked position, each clamp secures or presses a respective edge margin of the canvas door 40 against a respective mounting flange.

Referring to FIGS. 3, 4, 8, 9, 14 and 15, the locking system 100 includes a bottom locking assembly 102 connected to the bottom edge 22 of the rear opening 12, a first or left side locking subassembly 104L connected to the first or left side edge 24 of the rear opening and a second or right side locking subassembly 104R connected to the second or right side edge 26 of the rear opening. The first side locking subassembly 104L and the second side locking subassembly 104R are substantially the same. More specifically, the second side locking subassembly 104R is of mirror image construction of the first side locking subassembly 104L and operates in the same way. Thus, where similar or identical parts are used in the first and second side locking subassemblies 104L, 104R, identical reference numbers are employed. Accordingly, only the first side assembly will be described in detail. It will be understood that the first and second side locking assemblies 104L, 104R can be of different construction within the scope of the present invention.

Figure 3:
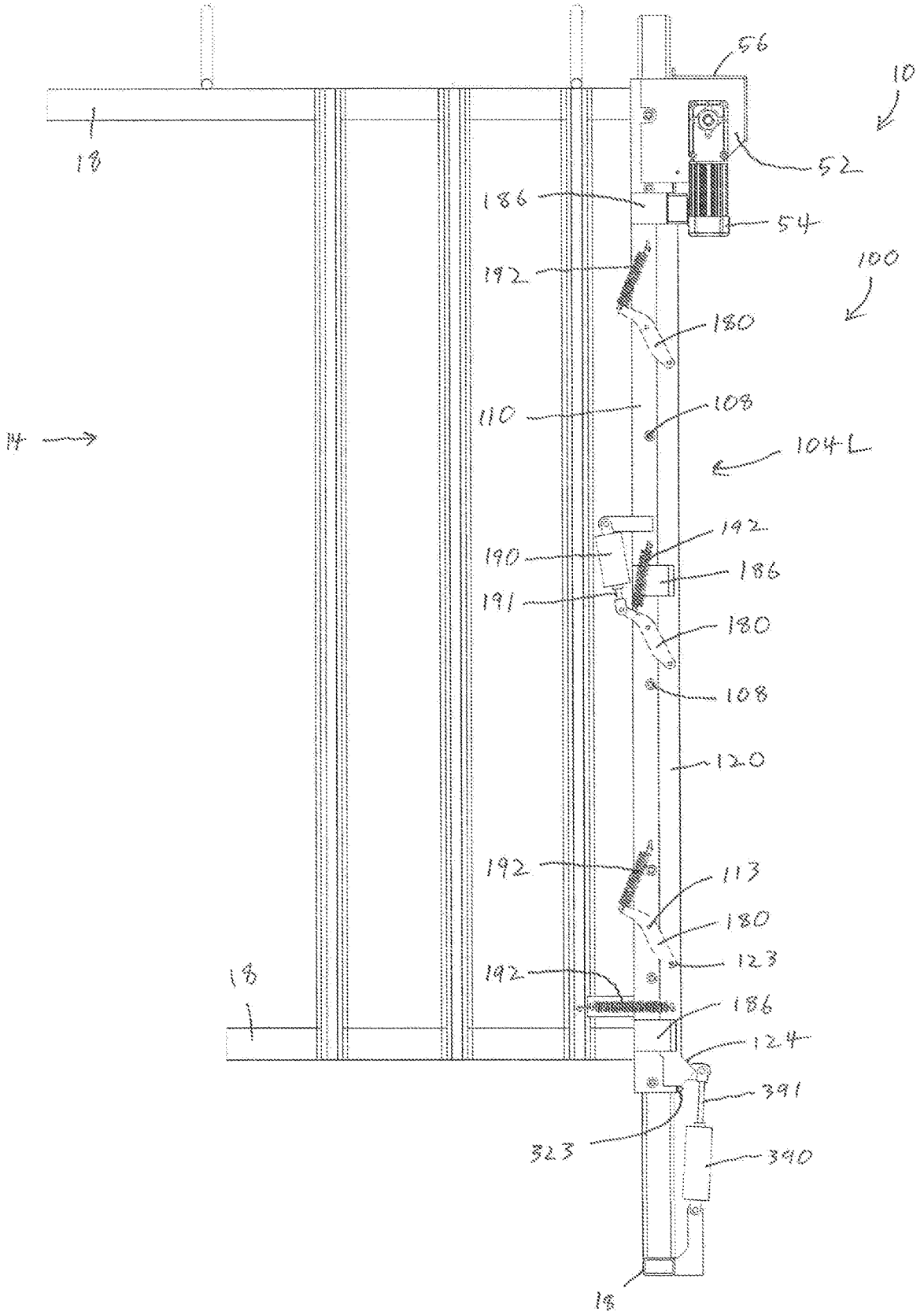
FIG. 3 is a left side view thereof.
Figure 4:
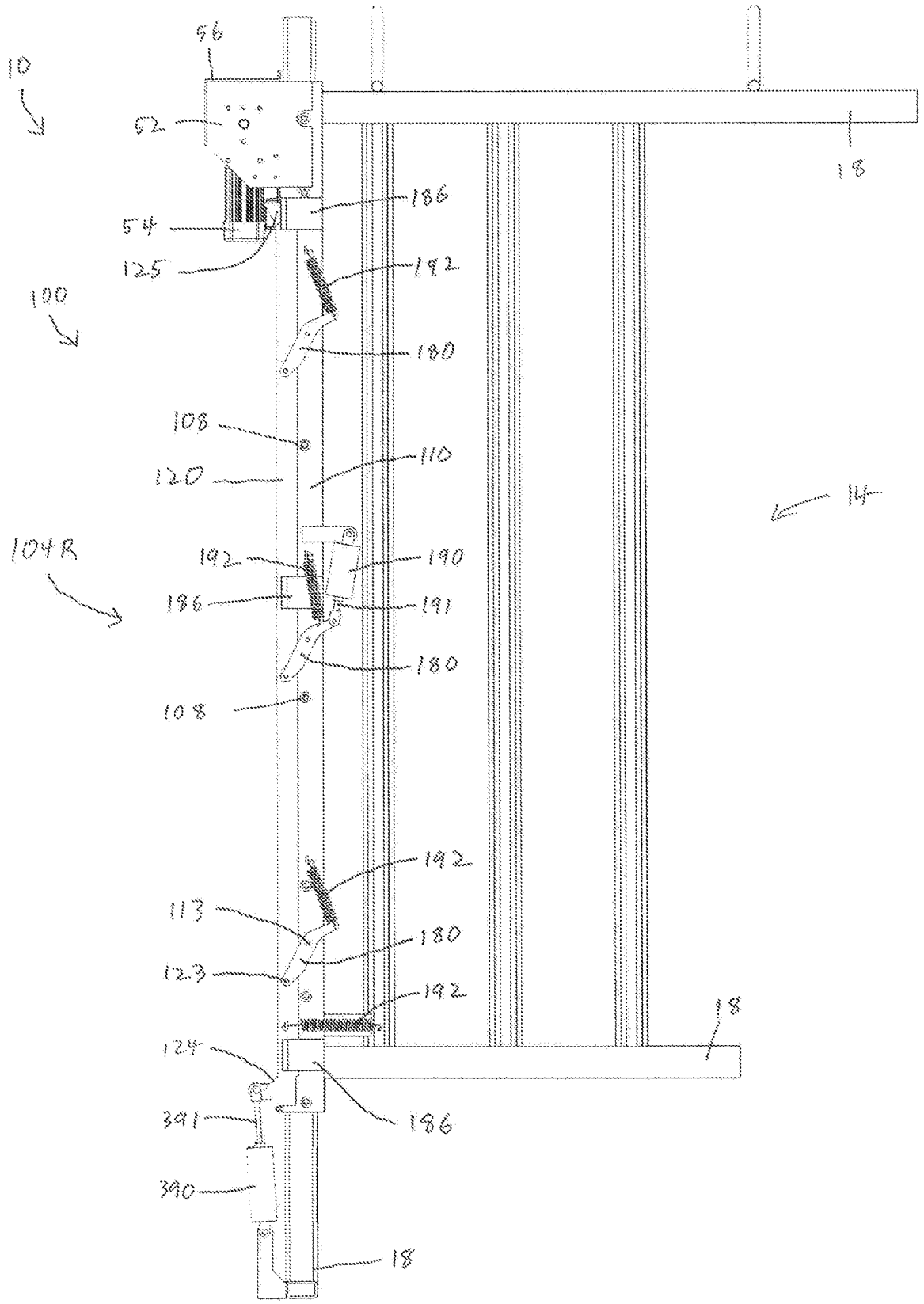
FIG. 4 is a right side view thereof.
Figure 8:
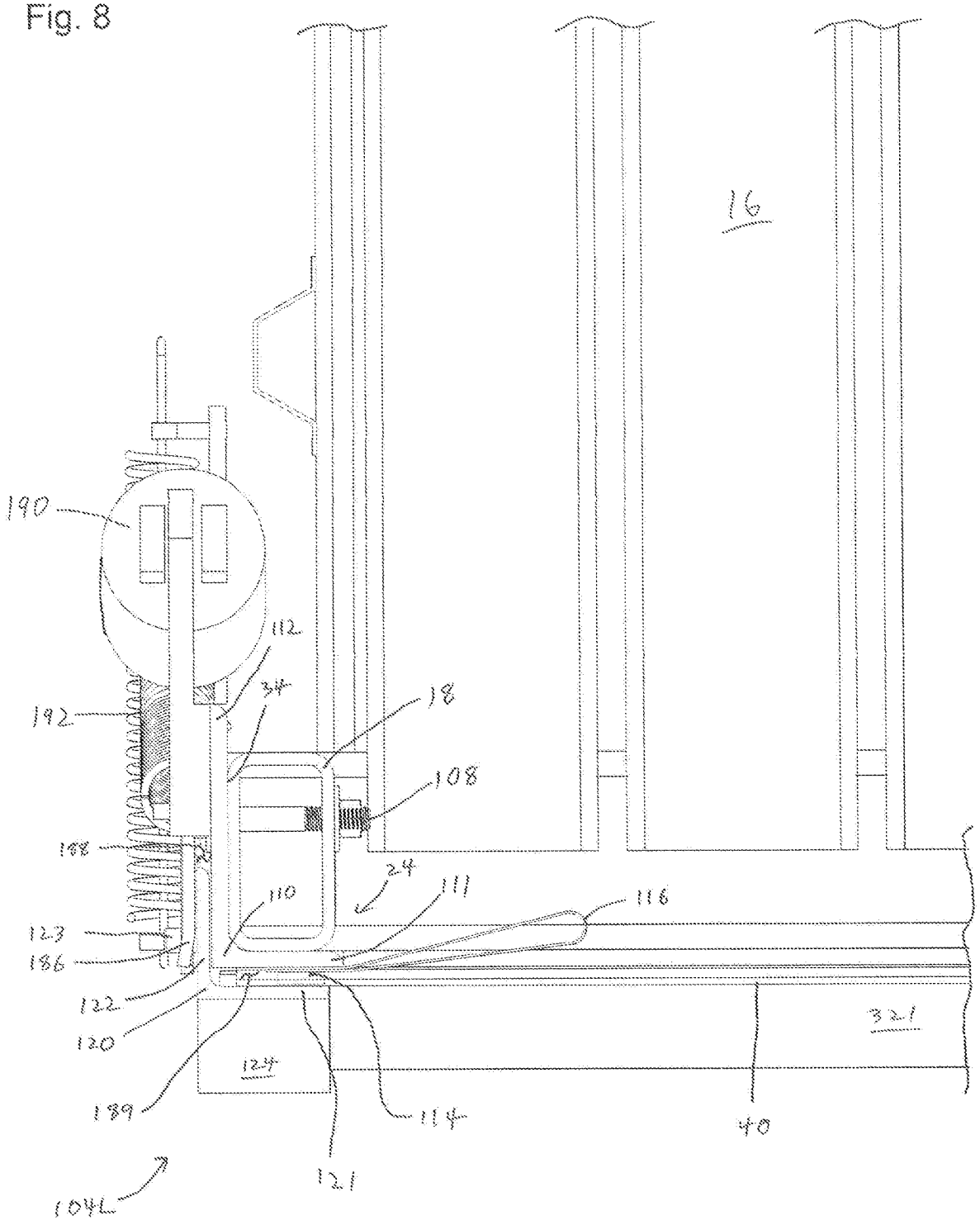
FIG. 8 is an enlarged fragmentary horizontal section taken through the line 8-8 of FIG. 2.
Figure 9:
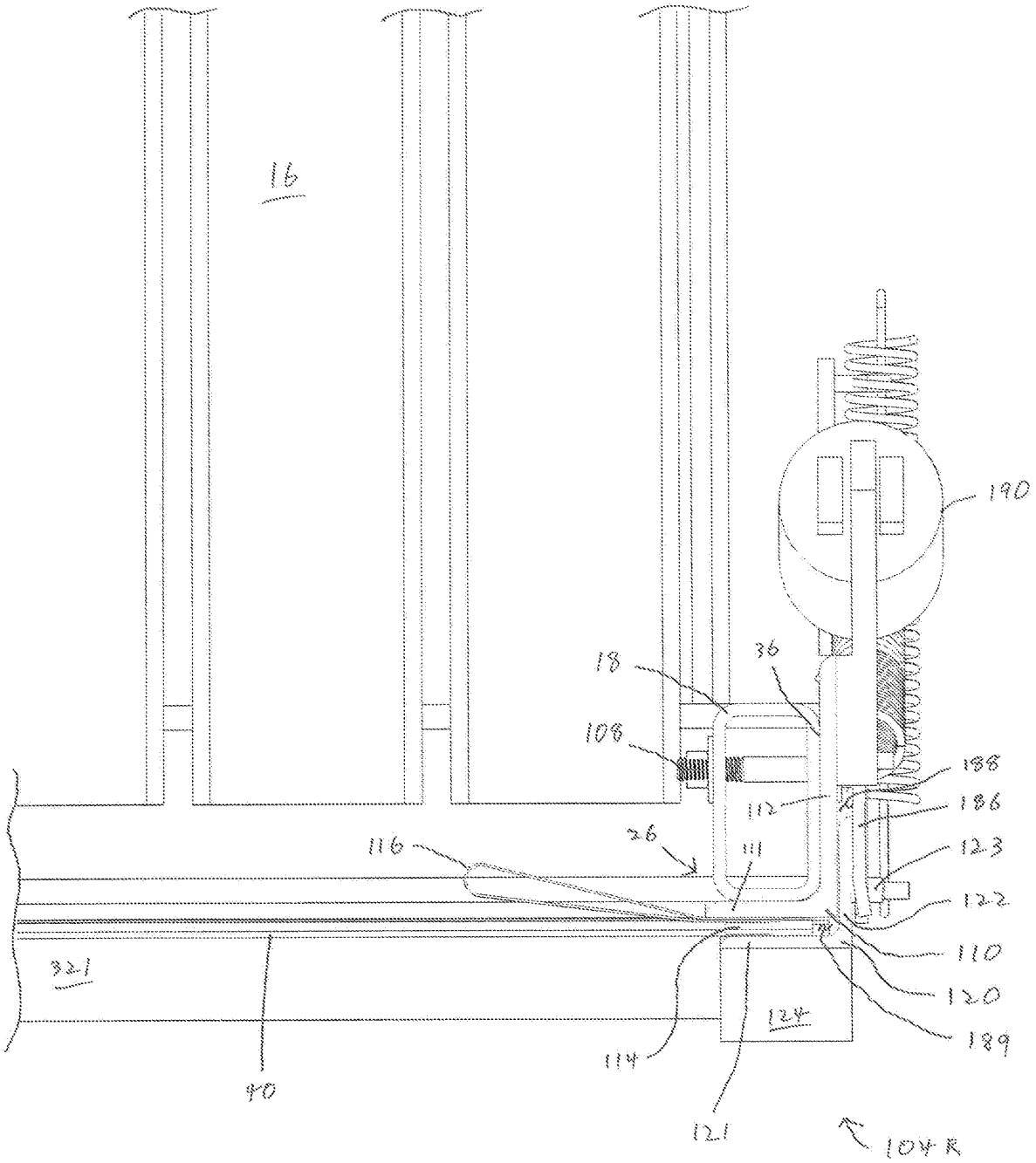
FIG. 9 is an enlarged fragmentary horizontal section taken through the line 9-9 of FIG. 1.
Figure 14:
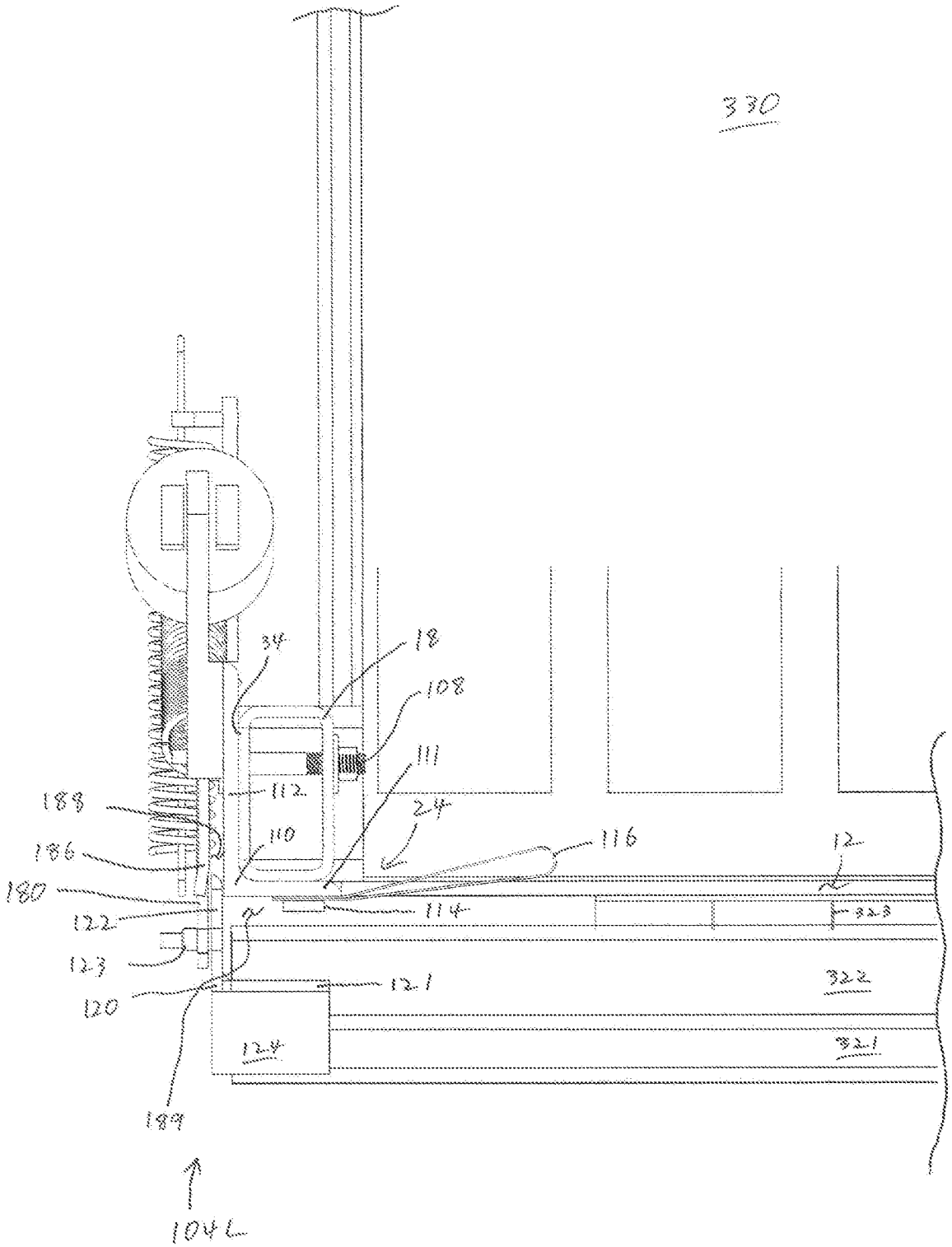
FIG. 14 is an enlarged fragmentary horizontal section taken through line 14-14 of FIG. 10.
Figure 15:
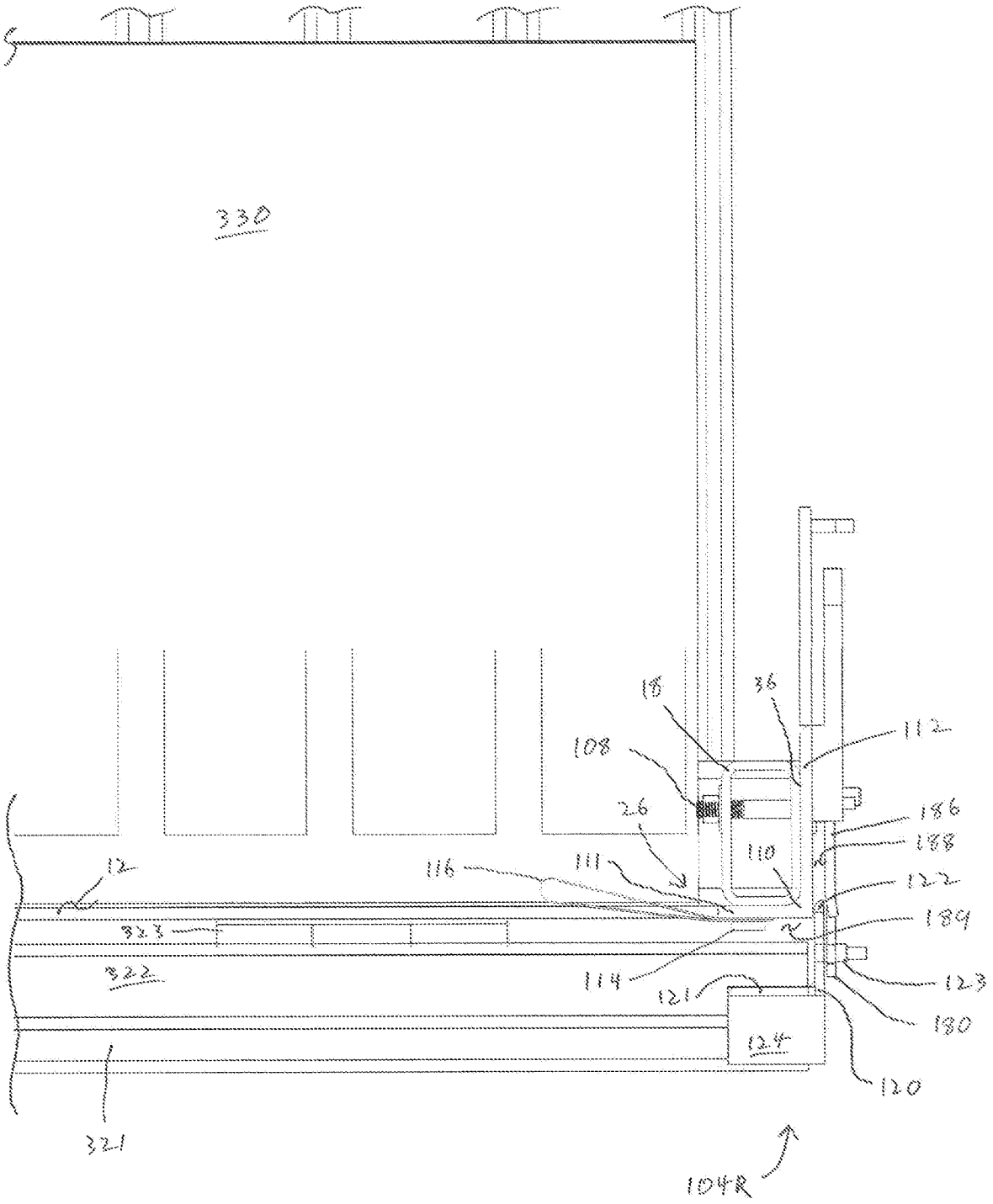
FIG. 15 is an enlarged fragmentary horizontal section taken through line 15-15 of FIG. 10.

As best seen in FIGS. 3, 8, and 14, the first side locking subassembly 104L includes the side mounting flange 110 and a clamp 120. The side mounting flange 110 is attached to the first side edge 24 of the rear opening 12. The side mounting flange 110 is an angle iron connected to the frame 18 of the trailer 14. In the illustrated embodiment, the side mounting flange 110 includes a plurality of openings to receive fasteners or bolts 108 to connect the side mounting flange to the trailer 14. It is to be understood that the side mounting flange 110 may be secured to the trailer 14 with other means than describe herein, such as by welding, that are within the scope of the present invention. One leg 111 of the side mounting flange 110 angle iron overlaps the frame 18 of the trailer 14 adjacent to the rear opening 12 along the first side edge 24 and forms a sealing face for the canvas door 40 to bear against. The other leg 112 of the side mounting flange 110 overlaps the frame 18 along a first exterior side 34 of the trailer 14. Thus, the side mounting flange 110 is connected to the trailer 14 such that it overlaps the corner between the first exterior side 34 and rear of the trailer 14. The side mounting flange 110 extends from the bottom edge 22 to the top edge 20 of the rear opening 12.

The clamp 120 is movably secured over the side mounting flange 110 adjacent to the first side edge 24. As seen in FIG. 8, the clamp 120 is an angle iron with one leg 121 overlapping the leg 111 of the side mounting flange 110 and the other leg 122 overlapping the other leg 112 of the side mounting flange. The clamp 120 extends along the first side edge 24 from the bottom edge 22 of the rear opening 12 up toward the top edge 20. The top of the clamp 120 is positioned below the shaft 50 and guide bar 58. At the bottom of the clamp 120, a bottom portion 124 of the leg 121 flares rearward or away from the rear of the trailer 14. The leg 122 extends outward in correspondence with the flared bottom portion 124 and is connected to the flared bottom portion. As described in more detail below, the bottom portion 124 of the clamp 120 is configured to overlap and engage a third, bottom clamp 160. Referring to FIG. 6, a top portion 125 of the leg 111 flares rearward from the trailer 14. The top portion 125 forms a ramp that guides the canvas door 40 in-between the side mounting flange 110 and the clamp 120 when the canvas door moves from an open position to a closed position. The top portion 125 engages one end of the rod 42 as the canvas door 40 is lowered, pushing the rod into a channel 189 between the side mounting flange 110 and the clamp 120.

The leg 121 of the clamp 120 and leg 111 of the side mounting flange 110 define the door receiving channel 189 adjacent to the first side edge 24. A clamp bar 114 is secured to the leg 111 of the side mounting flange 110 and extends into the door receiving channel 189. The clamp bar 114 is a continuous strip that extends along the side mounting flange 110. The clamp bar 114 is made of extruded aluminum that is essentially non-deformable, however, any suitable material can be used. In one embodiment, the clamp bar 114 is formed with teeth (not shown) extending lengthwise of the clamp bar that engage the tarp door 40 to grip the door and hold it in place when clamped. Other ways of gripping the tarp door 40 may be used within the scope of the present invention. A vertical rubber seal 116 is positioned between the clamp bar 114 and side mounting flange 110. The seal 116 extends along the side mounting flange 110. The seal 116 is a thin sheet of rubber folded back onto its self. The fold or bend of the seal 116 extends into the rear opening 20.

Fasteners (not shown) connect the clamp bar 114 and seal 116 to the leg 111 of the side mounting flange 110.

The clamp 120 is movably connected to the side mounting flange 110 by a plurality of levers 180. In the illustrated embodiment, three levers 180 located near the top, middle and bottom of the first side edge 24 are used to connect the clamp 120 to the side mounting flange 110. Each lever 180 has an opening at one end thereof configured to receive a pin 123 extending from the leg 122 of the clamp 120. Another opening near the middle of each lever 180 receives a pin 113 extending from the leg 112 of the side mounting flange 110. A third opening is located at the other end of the lever 180. As explained in more detail below, the third opening connects the lever 180 to a spring 192 or linear actuator 190. The lever 180 may rotate about pin 113. While the lever 180 is connected to the clamp 120 and side mounting flange 110 with pins, it is to be understood that any means of connection between the clamp, side mounting flange and levers, is within the scope of the present invention.

A linear actuator 190 is connected to one of the levers 180 to move the clamp 120 between the locked position, as seen in FIG. 8, and the unlocked position, as seen in FIG. 14. The linear actuator 190 is secured to the side mounting flange 110 with the piston rod 191 of the linear actuator secured to the third opening of the lever 180. In the illustrated embodiment, the linear actuator 190 is connected to the middle lever 180. Springs 192 are connected to the levers 180 and directly to the clamp 120 to bias the clamp toward the locked position. As seen in FIG. 3, one end of the spring 192 is connected to the side mounting flange 110. The other end of the spring 192 can then be connected to the lever 180 or the clamp 120. In the illustrated embodiment, three springs 192 are connected to corresponding levers 180. A fourth of the springs 192 is positioned near the bottom of the side mounting flange 110 and directly connects to the clamp 120 and the side mounting flange 110. The levers 180 located at the top and bottom of the clamp 120 use the third opening to attach to the springs 192. The middle lever 180 is attached to the spring 192 through a fourth opening positioned near the third opening. It is to be understood that any suitable attachment method can be used to attach the springs 192. Moreover, other mechanisms for opening and closing the clamp 120, is within the scope of the present invention. The linear actuator 190 is pneumatic and can be connected to the pneumatic system of the truck (not shown) pulling the trailer 14.

A plurality of guides 186 are fixed to the side mounting flange 110. The guides 186 guide movement of the clamp 120 when the clamp moves between the locked and unlocked positions. Each guide 186 is a flat metal plate fixed to but off set from the leg 112 of the side mounting flange 110. The guide 186 and leg 112 of the side mounting flange 110 define a channel 188 (FIG. 8). The channel 188 has an open side adjacent to the leg 111 of the side mounting flange 110 and open ends. The edge of the guides 186 at the open side flares outward. The leg 122 of the clamp 120 extends into the channel 188 through the open side and out each open end. The channel 188 helps control the movement of the clamp 120, as the clamp slides between the locked and unlocked positions. In the illustrated embodiment, three guides 186 are positioned near the top, middle and bottom of the clamp 120. It is to be understood that more or fewer guides 186 can be used.

Referring to FIGS. 1-9, the canvas door 40 is shown in a closed position and the locking system 100 is shown in a locked position. In this configuration, the rear opening 12 of the trailer 14 is closed and the trailer can retain particulate material (not shown). The locking mechanism 100 is in locking engagement with the canvas door 40 to secure the canvas door along first and second side edges 24, 26 and the bottom edge 22 (i.e. the first, second and third edges). When the locking mechanism 100 is in locking engagement with the canvas door 40, the locking mechanism provides a continuous seal along the edges so that no particulate material can slip through and escape the trailer 14.

Referring to FIG. 8, when the clamp 120 is in the locked position and the canvas door 40 is in the closed position, the clamp is in locking engagement with the canvas door. In the closed position, the edge margin of the canvas door 40 extends into the door receiving channel 189, overlapping the side mounting flange 110. In the locked position, the leg 121 of the clamp 120 engages and compresses the edge margin of the canvas door 40 against the leg 111 of the side mounting flange 110. Specifically, the clamp 120 compresses the edge margin of the canvas door 40 against the clamp bar 114 in the door receiving channel 189. The clamp 120 presses the edge margin of the canvas door 40 along the first side edge 24 over a majority of a length of the first side edge. Thus, a continuous seal is formed between the canvas door 40 and clamp 120 extending from the bottom edge 22 to the top of the clamp. It is appreciated that the clamp 120 may extend slightly below the bottom edge 22 to ensure the first clamp secures the canvas door along the first side edge 24 at the bottom edge. The engagement between the clamp 120, the side mounting flange 110 and the edge margin of the canvas door 40 prevents any particulate material (not shown) from escaping. The seal 116 also assists in preventing any particulate material from escaping. As the trailer 14 is loaded with particulate material from the top, the particulate material spreads out along the live floor 16 and contacts the seal 116. The particulate material pushes the seal 116 against the canvas door 40, preventing the particulate material from entering the door receiving channel 189. Thus, the seal 116 prevents the particulate material from escaping through the first side edge 24. The seal 116 also keeps the door receiving channel 189 clear of any particulate material that might prevent the canvas door 40 from moving to the open position when the trailer 14 is fully loaded.

Referring to FIG. 14, when the clamp 120 is in the unlocked position, the clamp is free of locking engagement with the canvas door 40. In the unlocked position, the clamp 120 is not in contact with the side mounting flange 110 but is spaced apart from it. By moving the clamp 120, the width of the channel 189 is increased to allow the canvas door 40 and rod 42 to freely pass through, allowing the door to be moved between the open and closed positions.

To move the clamp 120 into the unlocked position, the linear actuator 190 extends the piston rod 191, which in turn, rotates the lever 180 counterclockwise and moves the clamp away from the side mounting flange 110. The linear actuator 190 must overcome the biasing force of the springs 192 that hold the clamp 120 in the locked position. Once the piston rod 191 is fully extended, the clamp 120 is in the unlocked position and free from locking engagement with the canvas door 40. In the unlocked position, there is enough space between the leg 121 of the clamp 120 and leg 111 of the first side mounting bracket 110 to allow the canvas door 40 and rod 42 to pass through. To move the clamp 120 into the locked position, the linear actuator 190 retracts the piston rod 191 which rotates the connection bracket 180 in the opposite direction (clockwise) and moves the clamp toward the side mounting flange 110. Once the piston rod 191 is retracted, the clamp 120 is in the locked position and in locking engagement with the canvas door 40. The levers 180 not connected to the linear actuator 190 act as supports for the clamp 120 and are rotated by the clamp as it moves between the locked and unlocked positions. The springs 192 assist in the movement of the clamp to the locked position and maintains the clamp 120 in the locked position.

Figure 5:
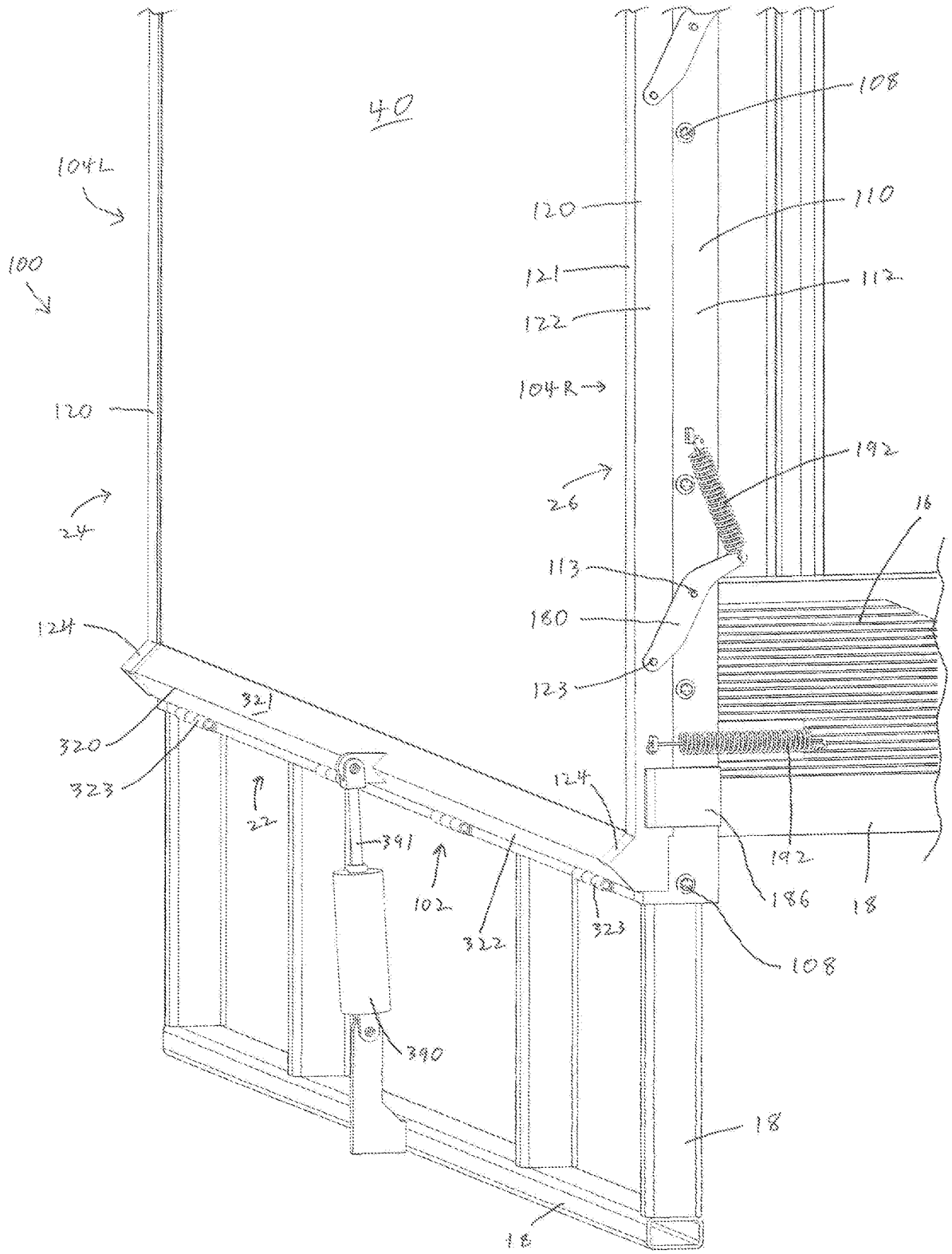
FIG. 5 is an enlarged fragmentary perspective view of the bottom thereof.
Figure 11:
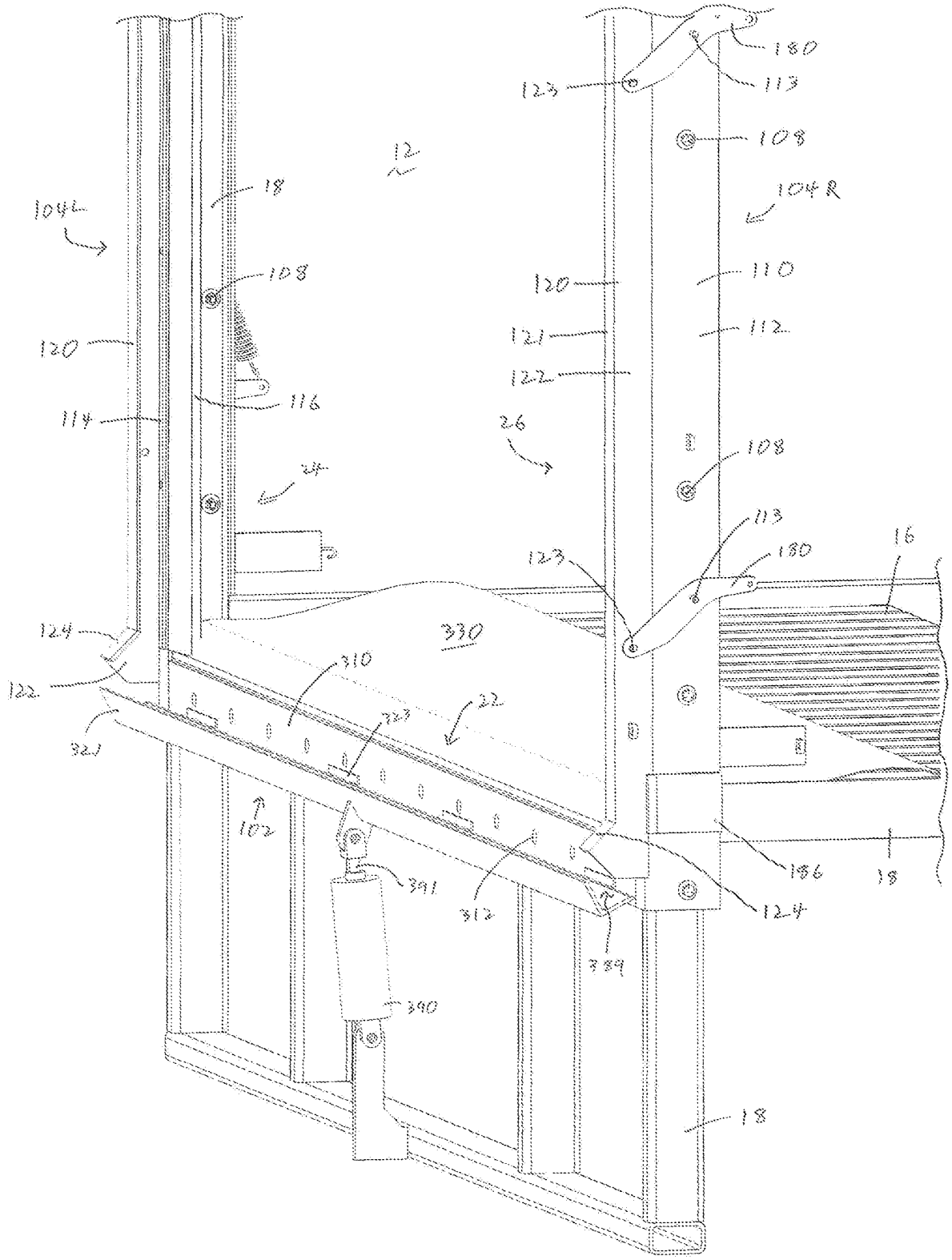
FIG. 11 is an enlarged fragmentary perspective view of the bottom thereof.
Figure 12:
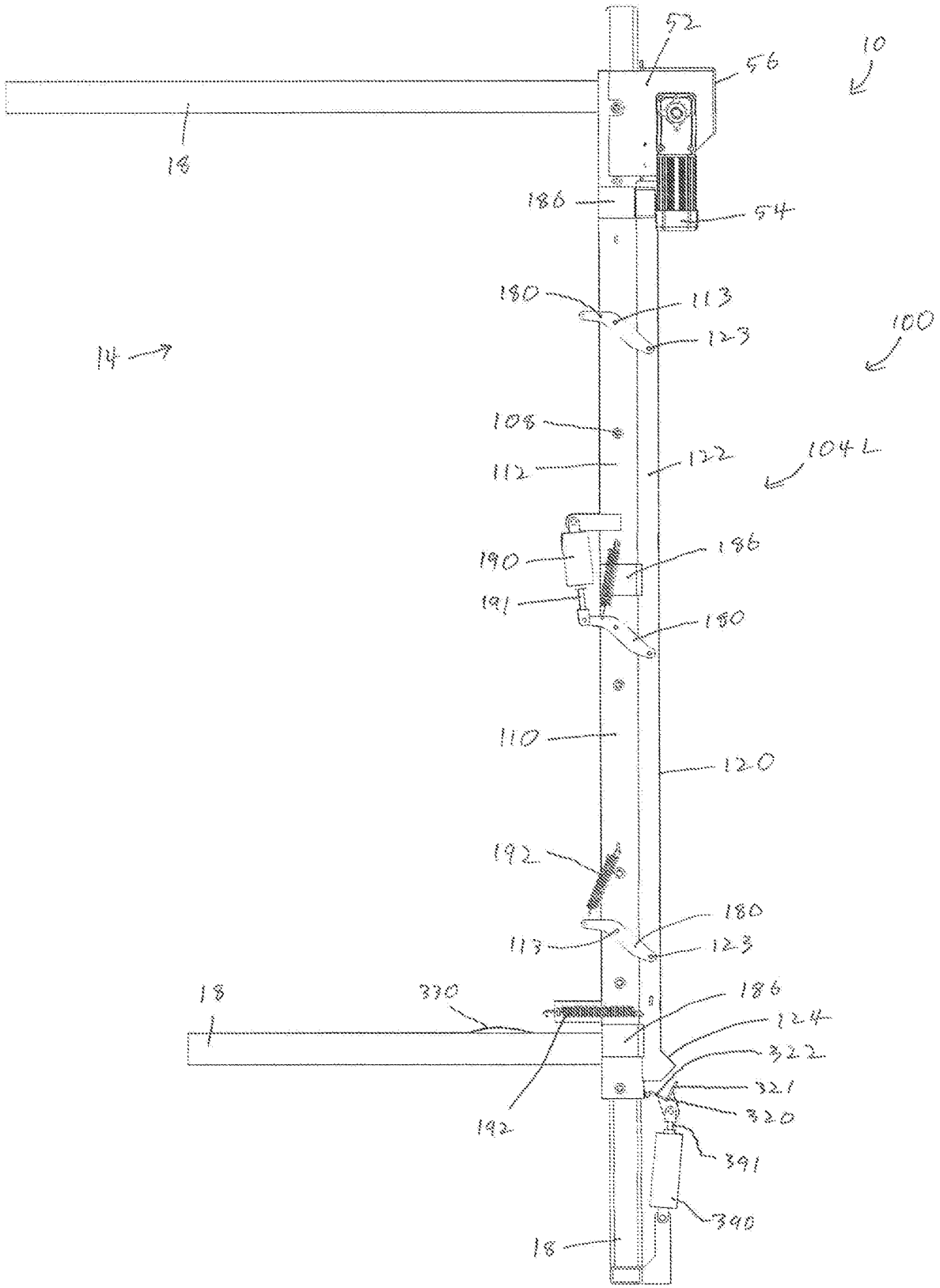
FIG. 12 is a left side view thereof.
Figure 13:
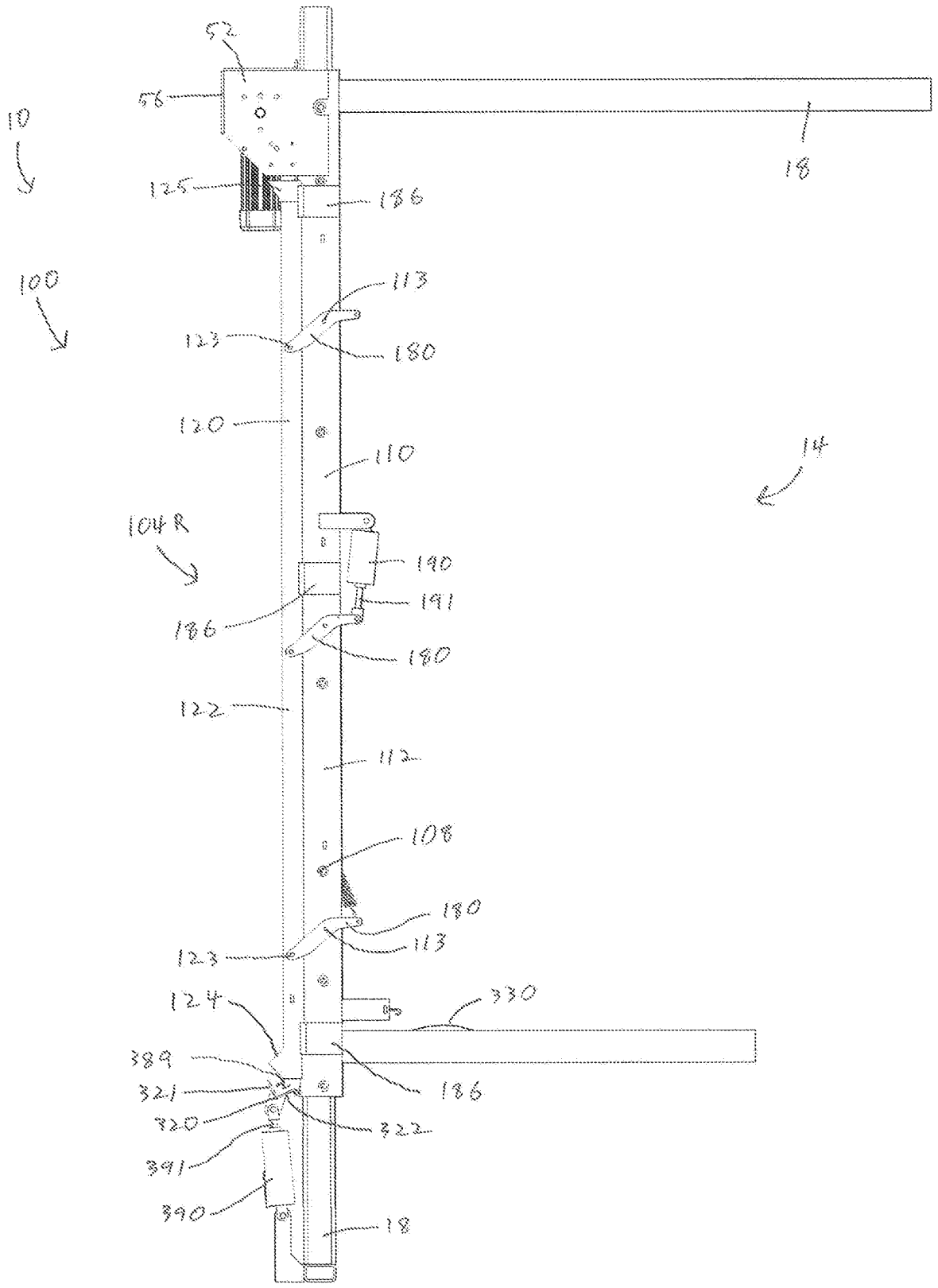
FIG. 13 is a right side view thereof.

As best seen in FIGS. 5 and 11, the bottom locking subassembly 102 of the locking mechanism 100 on the bottom or third edge 22 includes a third mounting flange 310 and a third clamp 320. The third mounting flange 310 is attached to the bottom edge 22 of the rear opening 12. The third mounting flange 310 is a flat, rectangular piece of metal connected to the frame 18 of the trailer 14. In the illustrated embodiment, the third mounting flange 310 includes a plurality of openings 312 to receive fasteners (not shown) to connect the third mounting flange to the trailer 14. It is to be understood that the third mounting flange 310 may be secured to the trailer 14 with other means than described herein, such as by welding, that are within the scope of the present invention. The third mounting flange 310 overlaps the frame 18 of the trailer 14 adjacent to the rear opening 12 along the bottom edge 22 and extends below the rear opening. The third mounting flange 310 extends between the side mounting flanges 110 of the first and second side locking subassemblies 104L, 104R.

The third clamp 320 is pivotably secured by hinges 323 (FIG. 5) to the third mounting flange 310 adjacent to the bottom edge 22. As seen in FIG. 11, the third clamp 320 is an angle iron with two legs 321 and 322 of equal widths. The third clamp 320 (FIG. 11) extends along the bottom edge 22 with each end overlapping the side mounting flange 110 of the first or second locking subassembly 104L, 104R. The hinges 323 are attached to the lower end of the third mounting flange 310 and the free edge of the leg 322. In the illustrated embodiment, four spaced apart hinges 323 are used to attach the third clamp 320 to the third mounting flange 310. However, any number of hinges 323 may be used, including one continuous hinge extending along the third clamp 320. The legs 321, 322 (FIG. 11) of the third clamp 320 define a pocket 389 adjacent to the bottom edge 22. The pocket 389 receives the rod 42 of the canvas door 40 to secure the door in the closed position. As described in more detail below, a tarp 330 can be positioned between the third mounting flange 310 and the frame 18 of the trailer 14 to cover the third clamp 320. In the illustrated embodiment, the tarp 330 spans between the first and second side edges 24, 26 and extends from the bottom edge 22 toward the front of the trailer 14 along the live floor 16.

A linear actuator 390 is connected to the third clamp 320 and the frame 18 of the trailer 14 below the third mounting flange 310. The linear actuator 390 moves the third clamp 320 between the locked position, as seen in FIG. 5, and the unlocked position, as seen in FIG. 11. A piston rod 391 of the linear actuator 390 is secured to the middle of the third clamp 320. The linear actuator 390 is pneumatic and can be connected to the pneumatic system of the truck (not shown) pulling the trailer 14.

Referring to FIG. 5, when the third clamp 320 is in the locked position and the canvas door 40 is in the closed position, the third clamp is in locking engagement with the canvas door. In the closed position, the lower edge margin of the canvas door 40 extends below the rear opening 12 in-between the third clamp 320 and third mounting flange 310. In the locked position, the third clamp 320 secures the rod 42 of the canvas door 40 in the pocket 389 between the legs 321, 322 and the third mounting flange 310. The free edge of the leg 321 of the third clamp 320 engages and compresses the lower edge margin of the canvas door against the third mounting flange 310. The third clamp 320 presses the lower edge margin of the canvas door 40 along the bottom edge 22. Thus, a continuous seal is formed between the canvas door 40 and the third clamp 320 extending between the first and second side edges 24, 26. The engagement between the third clamp 320, the third mounting flange 310 and the lower edge margin of the canvas door 40 prevents any particulate material (not shown) from escaping.

In the locked position, the rod 42 is securely held within the pocket 389 and prevents the canvas door 40 from breaking free of the third clamp 320 when the canvas door supports the particulate material (not shown) in the trailer 14. The particulate material pushes against the canvas door 40 and could pull the lower edge margin of the canvas door 40 out from engagement with the third clamp 320. However, because the rod 42 is held within the pocket 389, the canvas door 40 is able to resist the forces placed on it by the particulate material and remain in the closed position.

When the locking system 100 is in the locked position, the bottom portions 124 of the clamps 120 overlap and engage each end of the third clamp 320. More specifically, the bottom portions 124 compress or push each end of the leg 321 of the third clamp 320 against the side mounting flanges 110. This further secures the third clamp 320 in the locked position, taking advantage of the closing force of the springs 192. Because the clamps 120 are biased toward the locked position and engage the third clamp 320 when in the locked position, separate springs are not required to bias the third clamp in the locked position. In the illustrated embodiment, each leg 122 of the clamps 120 extend along the bottom portions 124 to close off the open ends of the third clamp 320 in the locked position. This protects the bottom edge of the canvas door 40 and the rod 42 from the elements when the canvas door is in the closed position. Closing off the open ends of the third clamp 320 also prevents the particulate material from escaping.

Referring to FIG. 11, when the third clamp 320 is in the unlocked position, the third clamp is free of locking engagement with the canvas door 40. In the unlocked position, the leg 321 of the third clamp 320 is not in contact with the third mounting flange 310 but is spaced apart from it. By moving the third clamp 320, the distance between the leg 321 and the third mounting flange 310 is increased to allow the canvas door 40 and rod 42 to freely pass through, allowing the door to be moved between the open and closed positions. As the particulate material is unloaded from the trailer 14, the tarp 330 is draped over the third clamp 320 and linear actuator 390 to prevent particulate material from catching on parts of the locking system 100.

To move the third clamp 320 into the unlocked position, the linear actuator 390 retracts the piston rod 391, which rotates the third clamp downward and away from the mounting flange 310. Once the piston rod 391 is fully retracted, the third clamp 320 is in the unlocked position and free from locking engagement with the canvas door 40 and rod 42. In the unlocked position, there is enough space between the leg 321 of the third clamp 320 and the third mounting bracket 310 to allow the canvas door 40 and rod 42 to pass out of the pocket 389. To move the third clamp 320 into the locked position, the linear actuator 390 extends the piston rod 391 which rotates the third clamp upward and toward the third mounting flange 310. Once the piston rod 391 is extended, the third clamp 320 is in the locked position capturing the rod 42 within the pocket 389 and sealing the canvas door 40 at the lower edge 22.

The canvas door 40 may include one or more metal rings (not shown) secured to the door's exterior surface adjacent to each side edge margin. The rings can engage a hook of a ratchet strap (not shown) to further secure the canvas door 40 to the trailer 14. Ratchets (not shown) can be fixed to the side mounting flanges 110. The ratchet strap hooks onto the ring at one end and wraps around the corner of the trailer 14 over the first or second locking subassembly 104R, 104L and connects one of the ratchets fixed to the side mounting flanges 110. It is appreciated that multiple metal rings and ratchets can be secured about edges of the rear opening 12. The ratchet straps prevent the edge margins of the canvas door 40 from breaking free of engagement with the clamps 120 due to the forces placed on the canvas door by the particulate material. However, the clamps 120 can be sufficient to secure the edges of the canvas door 40 on their own without the use of the ratchet straps.

A control panel (not shown) is connected to the door and locking system 10. The control panel can be connected to the truck's electrical system and can be used to link the truck's electrical system to the door and locking system 10. The control panel can be located anywhere on the trailer. The control panel can have a series of control features the user can activate to operate the door and locking system 10. The control panel is connected to the motor 54 and the linear actuators 190 and 390 connected to the clamps 120 and 320. To move the canvas door 40 between the open and closed positions, the user activates control features on the control panel. Once a control feature is activated, the control panel sends a signal to the motor 54 which turns the shaft 50 to raise or lower the canvas door into the open or closed position. The control panel can automatically stop the motor 54 once the canvas door 40 is in the open or closed position or the user can manually position the door. To move the locking system 100 into the locked and unlocked positions, the user actuates the corresponding control feature(s) on the control panel. The control panel can have a single set of control feature(s) that operates the entire locking system 100 or a series of control features that operates each clamp individually. Once a control feature is actuated, the control panel sends a signal to the linear actuators 190 and 390 to move the locking system 100 into the locked or unlocked position. In the preferred embodiment, the third clamp 320 operates independently from the clamps 120 so that the third clamp 320 can be moved into the locked position before the clamps 120. Securing the third clamp 320 in the locked position first allows the user to operate the motor 54 to pull the canvas door taught (i.e. remove the slack by attempting to raise the canvas door) before the clamps 120 are moved into the locked position.

It is appreciated that the door and locking system 10 described above can be sized to fit the rear rectangular opening of any trailer. To attach the door and locking system 10 to an existing trailer 14, the original doors of the trailer are removed along with any hinges or other components that protrude from the trailer frame 18 and would prevent the installation of the door and locking system 10. Then, the components of the door and locking system 10, such as the side mounting flanges 110, the clamps 120, the canvas door 40, the shaft 50, the third mounting flange 310 and third clamp 320, are all constructed to fit the rear opening 12 of the particular trailer 14. Once constructed, the side mounting flanges 110 and third mounting flange 310 are mounted on the trailer, as described above, followed by the clamps 120, the third clamp 320 and the canvas door 40. The linear actuators 190 and 390 are then connected to the truck's pneumatic system and the control panel. The motor 54 is also connected to the control panel. Finally, the control panel is connected to the truck's electrical system.

In view of the above, it will be seen that the several features of the invention are achieved and other advantageous results obtained.

The door and locking system 10 is able to completely open in confined spaces because in the open position, the canvas door 40 is wrapped around the shaft 50 near the top edge 20 of the rear opening 12. This arrangement conveniently stores the canvas door 40 in a compact raised position that can be obtained regardless of the delivery space size, unlike traditional doors which need space to swing open along the sides of the trailer. The control panel provides the user with the ability to open the rear opening 12 remote from the rear of the trailer 14. This eliminates the need for two people to unload the trailer if the delivery space is so tight that once the trailer has backed into the delivery space, a person cannot access the delivery space to open the doors unless they were already in the delivery space before the trailer was backed in. The locking system 100 provides a strong seal around the edges of the rear opening 12 to resist the forces placed on the canvas door 40 by the particulate material and prevent any particulate material from escaping.

In addition, the canvas door 40 can remain in the open position once the trailer 14 is unloaded as the trailer returns to pick up another load. Keeping the door 40 in the open position reduces air resistance or drag on the trailer, increasing fuel efficiency. The retractable top on the trailer 14 can be in its stored position on the return trip, leaving the top of the trailer open. This allows air to enter the trailer 14 and contact the rear doors that close the rear opening 12. Thus, the doors closing the rear opening 12 act as a giant wind screen, forcing any air that enters the trailer 14 to move up and over the doors. By keeping the canvas door 40 in the open position on the return trip, any air that enters the trailer 14 through the open top can pass through the rear opening 12. Thus, the air no longer contacts the rear doors of the trailer 12, reducing air resistance and increasing fuel efficiency.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above products without departing from the scope of the invention, it is intended that all matter contained in the above description and shown in the accompanying drawings shall be interpreted as illustrative and not in a limiting sense.

What is claimed is:

1. A door and locking system for a rear opening of a long bed trailer, the rear opening having a top edge, a bottom edge and first and second side edges, the door and locking system comprising:

a tarp door configured for mounting adjacent to the rear opening of the long bed trailer, the tarp door configured to move between a closed position in which the tarp door moves to close the rear opening and an open position in which the tarp door moves to open the rear opening; and a locking system, configured to be secured to the edges of the rear opening, the locking system comprising clamps configured to move between a locked position, in which the clamps are in locking engagement with the tarp door in the closed position to clamp the tarp door against the first side edge, second side edge, and bottom edge of the rear opening to close the opening for retaining fluidizable product in the long bed trailer and an unlocked position, in which the clamps of the locking system are free from locking engagement with the tarp door against the first side edge, second side edge, and bottom edge of the rear opening to allow the tarp door to move into the open position.

2. The door and locking system of claim 1, wherein the clamps include a first clamp configured to move between the locked and unlocked positions to secure the tarp door against the first side edge of the rear opening, a second clamp configured to move between the locked and unlocked positions to secure the tarp door against the second side edge of the rear opening and a third clamp configured to move between the locked and unlocked positions to secure the tarp door against the bottom edge of the rear opening.

3. The door and locking system of claim 2, wherein the first and second clamps are constructed so that in the locked position the first and second clamps press respective edge margins of the tarp door along the first and second edges over a majority of a length of the first and second edges.

4. The door and locking system of claim 2, wherein the third clamp in the locked position presses a respective edge margin of the tarp door along the bottom edge.

5. The door and locking system of claim 2, wherein the first clamp, second clamp and third clamp each comprise an L-shaped angle bar.

6. The door and locking system of claim 1, further comprising springs to bias the locking system in the locked position.

7. The door and locking system of claim 2, further comprising a linear actuator connected to each of the first clamp, second clamp and third clamp to move the first clamp, second clamp and third clamp between the locked and unlocked position.

8. The door and locking system of claim 2, further comprising guides configured to be disposed along the first and second side edges of the rear opening to guide the first and second clamps between the locked and unlocked positions.

9. The door and locking system of claim 1, further comprising a motor and a shaft, wherein when the tarp door is connected to an exterior of the trailer and is connected to the motor which is configured to rotate the shaft to move the tarp door between the closed and open positions, wherein most of the tarp door is wrapped around the shaft in the open position.

10. The door and locking system of claim 2, wherein the tarp door includes a rod secured to the tarp door, the rod configured to be engaged by the third clamp in the locked position.

11. The door and locking system of claim 2 wherein the locking system comprises at least one mounting flange configured to mount onto at last one of the first and second side edges and bottom edge of the long bed trailer.

12. The door and locking system of claim 11 wherein the at least one mounting flange comprises a first mounting flange configured for mounting on the first side edge of the long bed trailer, the locking system further comprising a second mounting flange configured for mounting on the long bed trailer along the second side edge, and a third mounting flange configured for mounting on the bottom edge of the long bed trailer.

13. The door and locking system of claim 12 further comprising a first lever pivotally connecting the first clamp to the first mounting flange and a second lever pivotally connecting the second clamp to the second mounting flange.

14. A long bed trailer comprising:

a trailer frame defining a rear opening having a top edge, a bottom edge and first and second side edges;

a tarp door configured for mounting adjacent to the rear opening of the long bed trailer, the tarp door configured to move between a closed position in which the tarp door moves to close the rear opening and an open position in which the tarp door moves to open the rear opening; and a locking system, configured to be secured to the edges of the rear opening, the locking system comprising clamps configured to move between a locked position, in which the clamps are in locking engagement with the tarp door in the closed position to secure the tarp door against the first side edge, second side edge, and bottom edge of the rear opening to close the opening for retaining fluidizable product in the long bed trailer and an unlocked position, in which the clamps of the locking system are free from locking engagement with the tarp door against the first side edge, second side edge, and bottom edge of the rear opening to allow the tarp door to move into the open position.

15. The long bed trailer as set forth in claim 14, wherein the clamps include a first clamp configured to move between the locked and unlocked positions to secure the tarp door against the first side edge of the rear opening, a second clamp configured to move between the locked and unlocked positions to secure the tarp door against the second side edge of the rear opening and a third clamp configured to move between the locked and unlocked positions to secure the tarp door against the bottom edge of the rear opening.

16. The long bed trailer as set forth in claim 15, wherein the first and second clamps are constructed so that in the locked position the first and second clamps press respective edge margins of tarp door along the first and second edges over a majority of a length of the first and second edges.

17. The long bed trailer as set forth in claim 15, wherein the third clamp in the locked position presses a respective edge margin of the tarp door along the bottom edge.

18. The long bed trailer as set forth in claim 14, further comprising springs to bias the locking system in the locked position.

19. The long bed trailer 15, further comprising a linear actuator connected to each of the first clamp, second clamp and third clamp to move the first clamp, second clamp and third clamp between the locked and unlocked position.

20. The long bed trailer of claim 14, wherein the tarp door further comprises a motor and a shaft, the tarp door being connected to an exterior of the trailer and connected to the motor which is configured to rotate the shaft to move the tarp door between the closed and open positions, wherein most of the tarp door is wrapped around the shaft in the open position.

* * * * *